United States Patent [19]

Doke et al.

[11] Patent Number: 4,581,859

[45] Date of Patent: Apr. 15, 1986

[54] WALL STUD FOR SIMPLIFIED ASSEMBLY

[75] Inventors: Jack Doke, Walnut; Forrest E. Clemens, Sherman Oaks, both of Calif.

[73] Assignee: Clemco Roll Forming, Inc., City of Industry, Calif.

[21] Appl. No.: 667,137

[22] Filed: Nov. 1, 1984

[51] Int. Cl.[4] ..... A47F 5/00; E04C 3/32

[52] U.S. Cl. ..... 52/36; 52/238.1; 52/721

[58] Field of Search ..... 52/36, 720, 721, 726, 52/729, 730, 731, 732, 238.1

[56] References Cited

U.S. PATENT DOCUMENTS

| | | | |
|---|---|---|---|
| 3,509,669 | 5/1970 | Plemeng | 52/36 |
| 3,562,970 | 2/1971 | Schwartz | 52/36 |
| 3,570,198 | 3/1971 | Ruhnke | 52/36 |
| 3,638,370 | 2/1972 | Miller | 52/36 |
| 3,668,827 | 6/1972 | Schwartz | 52/36 |
| 3,848,364 | 11/1974 | Costruba | 52/36 |
| 3,925,939 | 12/1975 | Costruba | 52/36 |

*Primary Examiner*—J. Karl Bell

*Attorney, Agent, or Firm*—Elliott N. Kramsky

[57] ABSTRACT

An improved wall stud for use in framing a wall unit. Two separate sheet-like sections are roll formed with preselected folds and stitched together at a common double strength web. The composite stud includes an open surface channel for accepting a wall standard and bracket support structure as a unit so that installation costs are minimized.

5 Claims, 4 Drawing Figures

FIG. 2
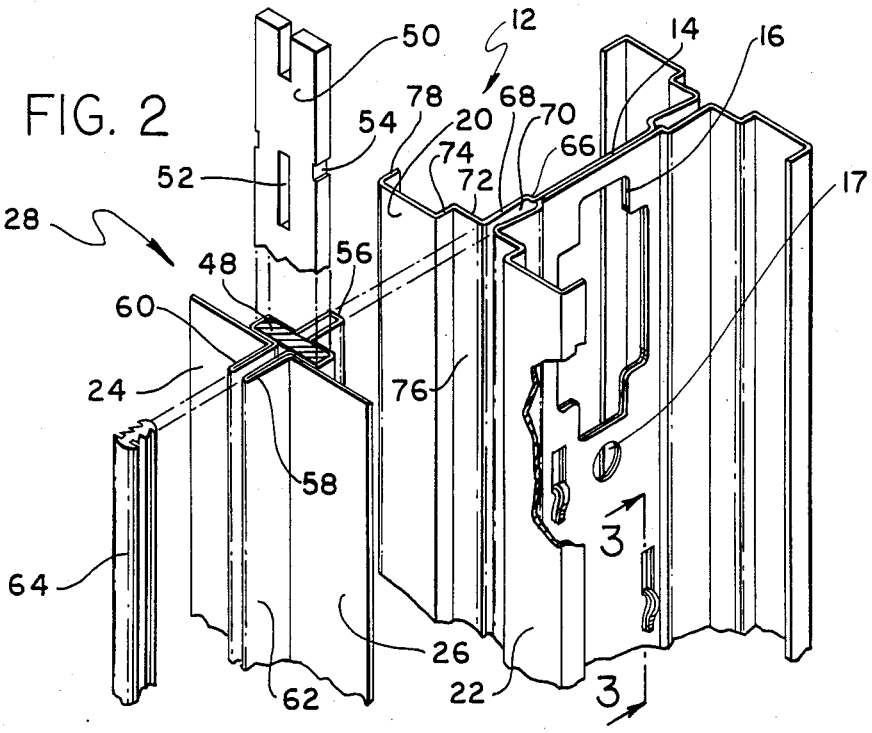
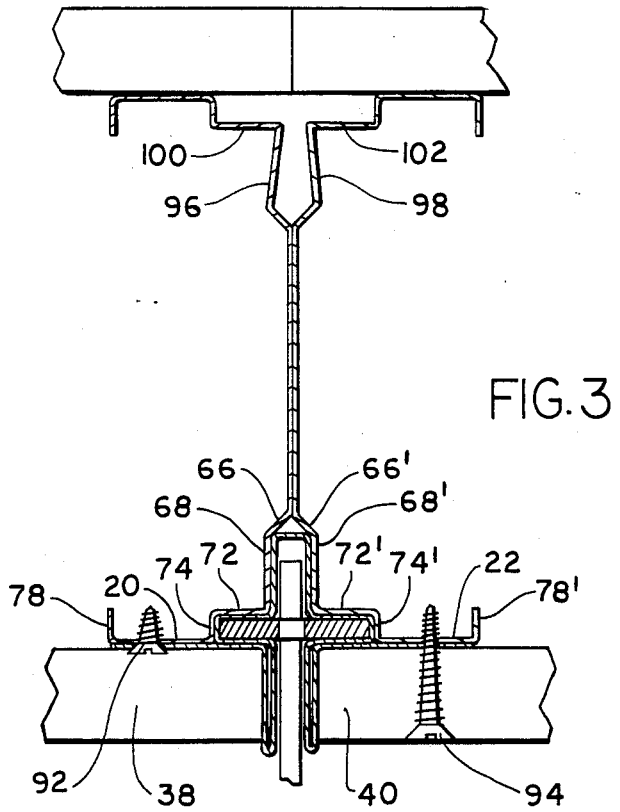
FIG. 3
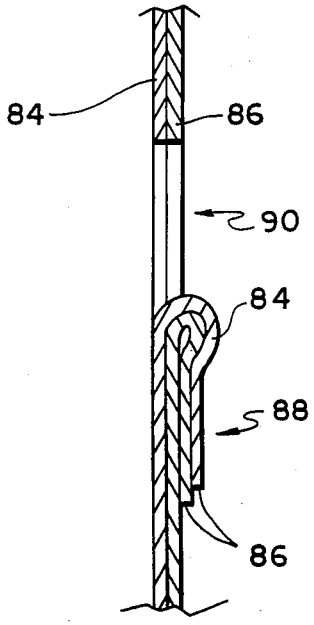
FIG. 4

WALL STUD FOR SIMPLIFIED ASSEMBLY

BACKGROUND

1. Field of the Invention

The present invention relates to structures for incorporation into wall structures of the type that include one or more panels of drywall material supported by a metal framed structure including a plurality of spaced-apart vertically arranged wall studs. More particularly, this invention pertains to a new wall stud structure that is advantageously configured for rapid and simplified wall frame assembly.

2. Description of the Prior Art

The wall unit formed of panels or sections of drywall, such as gypsum board, supported by a (preferably metallic) frame is a commonly employed and favored construction for retail business establishments and offices. A plurality of such units can be employed to define a semi-permanent arrangement of office or other space suitable to the retail or other business tenant's needs. Representative wall unit arrangements of this type are disclosed in the following U.S. Patent Ser. Nos.: 3,394,507 of Doke for "Metallic Structure for Interior Walls to Carry Shelf Brackets and Wallboard"; 3,407,547 of Doke et al. for "Metallic Wall Stud Structure for Supporting Shelf Brackets"; 3,492,766 of Andrews for "Adjustable Stud"; 3,509,669 of Plemens for "Support Structure for Shelving"; 3,714,748 of Costruba for "Support Structure for Shelving"; and 3,730,477 of Wavrunek for "Bracket Support Unit for Integral Wall Construction".

The vertically arranged wall studs not only provide a frame for supporting the wallboard panels but also must accommodate means for supporting one or more shelf brackets in many wall units. The brackets, in turn, may be used to support one or more shelves for merchandise, storage, books or the like—an extremely advantageous and often necessary feature that complicates both the design and installation of the wall studs.

The bracket support structure itself generally includes a wall standard comprising an elongated bar with a series of longitudinal slots for accommodating the inner tongue of the shelf bracket(s). An elongated housing must be provided for retaining and supporting the wall standard both with and without the additional weight of the bracket and shelves.

A number of arrangements have been adopted to engage the bracket support structure to the frame of the wall unit. Certain of these have included the incorporation of an elongated housing within the wall stud for directly receiving the slotted wall standard while others have employed a stud or stud arrangement adapted to receive a bracket support unit. In the latter instance the wall studs only secure the position of the wall standard indirectly.

The Doke, Doke et al., Plemens and Costruba patents generally disclose symmetrical arrangements of pairs of studs for supporting wall standards on either side of a wall unit. The opposed ends of the studs define laterally directed channels for accepting and supporting the wall standards. The vertical position of the wall standard within each laterally directed channel may be secured by means of screws, clips or the like.

In each of the aforesaid arrangements, the channels formed within the stud substantially enclose the wall standard. Thus, when fabricating a wall unit incorporating such studs, the assembler must either handle a cumbersome unit including a pair of studs, wall standards and associated apparatus or work with a somewhat disassembled unit. In the former instance, the heavy and awkward unit demands considerable effort in attempting to attain proper plumbed location. Even then, some misalignment may occur with respect to the wall standard as some "play" is inevitable within the retaining channels. In the latter instance, a nearly impossible task awaits the assembler after aligning the stud. The wall standard is generally of sufficient length to render the sliding of the standard into the channel a most difficult task.

The Wavrunek patent discloses a wall construction in which the wall standard is secured within an elongated extruded housing. The housing is independent of the wall studs which are simply U-shaped channels arranged back to back on either side of the housing. While offering certain advantages in terms of simplicity, the fabrication of a wall unit including such arrangements is complex and exacting. The studs are individually positioned, doubling the opportunity for error in placement. Even a small error or misalignment may prove to be both structurally and aesthetically disastrous. Thus, any economies due to its overall simplicity of design are more than overcome by the increased cost of proper installation of such an unit. An improved bracket support structure is disclosed in the pending U.S. patent application of the inventors herein Ser. No. 621,255, entitled "Integral Bracket Support Structure". The structure disclosed therein presents an economical roll formed structure that, like Wavrunek, is separate from the supporting wall studs.

While the various arrangements discussed above possess certain desirable features, they disclose that the prior art has failed to provide a wall stud construction, compatible with the needs of contemporary wall unit design, that offers economy of manufacture and ease, and hence economy, in wall unit fabrication.

SUMMARY OF THE INVENTION

The present invention addresses the foregoing and additional disadvantages of the prior art by providing an improved stud for use in framing a wall unit. The stud includes a pair of unitary stud portions. Each of the stud portions is a mirror image of the other and these portions are arranged back to back to form a common web.

Each stud portion includes at least one inner flange and an adjacent interior edge orthogonal thereto. Such arrangement defines a shoulder for forming an open surface channel.

In another aspect, the invention provides a wall unit construction member. The member includes means for retaining a wall standard. There is further provided means adapted to receive the last-named means that includes an open surface channel.

The preceding, and other, advantages and features of the invention will become further apparent from the detailed description that follows. The description is accompanied by a set of drawing figures. Numerals of the figures and the description refer to features of the invention, like numerals referring to like features of the invention throughout.

BRIEF DESCRIPTION OF THE DRAWINGS

FIG. 2 is an exploded perspective view of the cooperative arrangement of wall standard, bracket support and stud in accordance with the invention;

FIG. 3 is a sectional view taken at section line 3—3 of FIG. 1 indicating the cross-sectional geometry of the stud of the invention both with and without bracket support; and FIG. 4 is an enlarged sectional view taken at the line 4—4 of FIG. 2 that illustrates in detail the structure of the roll formed stitches that secure the common web of the stud.

DETAILED DESCRIPTION

Figure 1:
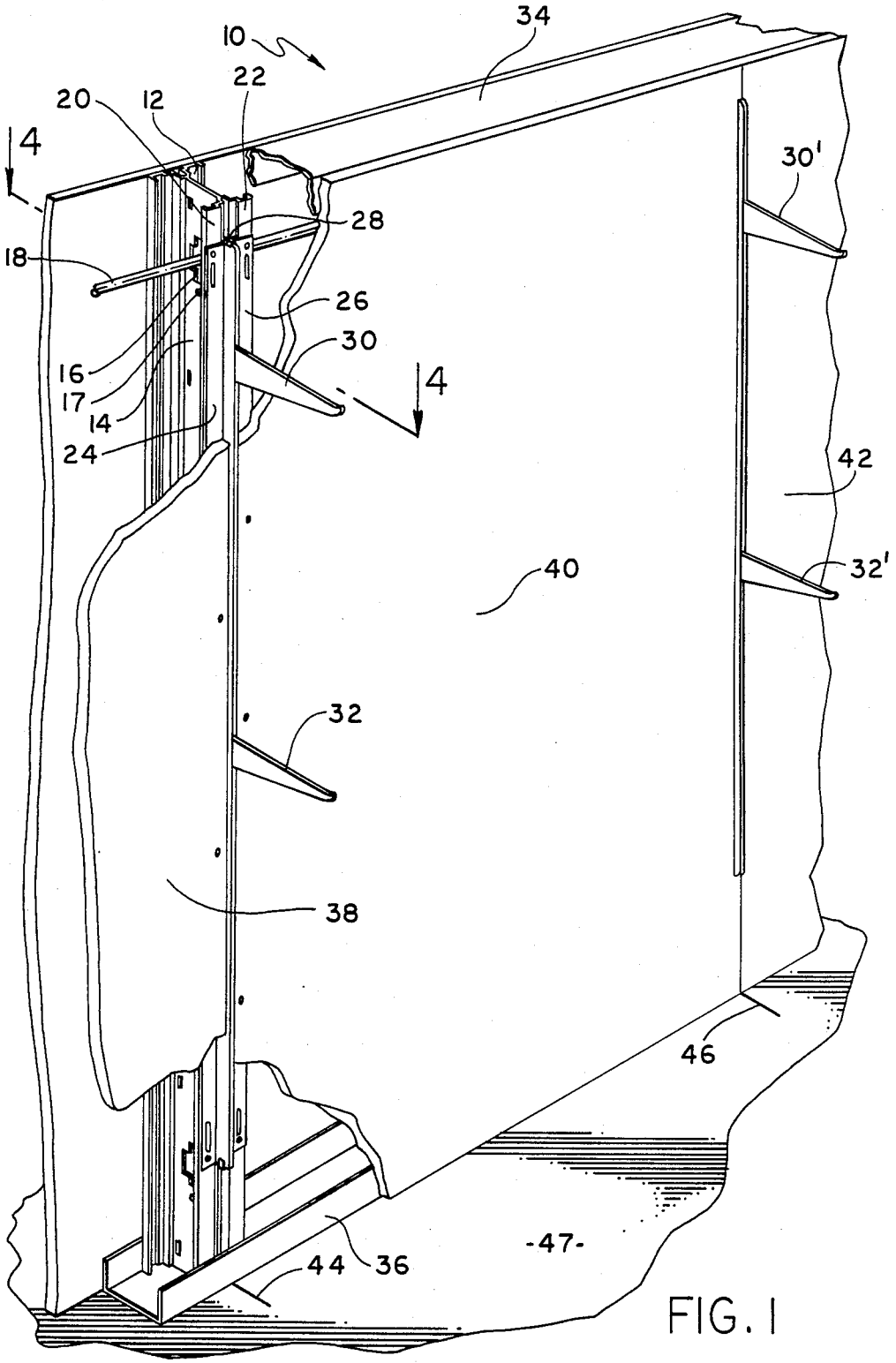
FIG. 1 is an overall partially broken perspective view of a wall unit, such as a partition, incorporating a stud in accordance with the invention.

Referring now to the drawings, FIG. 1 is an overall partially broken perspective view of a wall unit 10, such as a common partition, which incorporates a stud 12 in accordance with the invention. As mentioned supra, units or partitions of such nature are often found in offices, retail and other business environments.

The wall unit 10 includes a frame comprising a plurality of studs 12 in accordance with the invention. The wall stud of the invention will be described in greater detail infra. However, as can be seen in FIG. 1, the stud 12, formed preferably of either sheet metal or sheet steel, is of a generally back-to-back T-shape with common stem and transverse members arranged to coincide with opposed wallboard surface panels.

The stem of the T-shaped configuration extends from the top to the bottom of the stud 12 forming a double strength web 14. Polygonal and round apertures 16 and 17 respectively are provided within the extent of the web 14. Such apertures act as orifices which permit the passage of electrical conduit, reinforcing bars, such as the illustrated bar 18, and associated material for securing the reinforcing bar 18 to the frame of the wall unit 10. In the event a bar 18 were to pass through the polygonal aperture 16, the round aperture 17 is a useful location for passage of wire for securing the bar tightly to the bottom of the aperture 16, a preferred construction arrangement when a reinforcing bar 18 is employed in conjunction with a wall unit featuring the arrangement shown generally in FIG. 1.

Referring to the top of the T-shape that faces out of FIG. 1, this transverse member of the stud 12 is seen to include a pair of outer flanges 20 and 22 which are secured to and provide a base for mounting flanges 24 and 26 of an elongated bracket support 28. The support 28 secures a wall standard including a plurality of longitudinal slots for engaging the inner end of at least one wall bracket 30 that, in turn, protrudes from the wall unit to support a shelf perpendicular thereto. The bracket support 28 shown in FIG. 1 and, in somewhat greater detail in the following figure, is generally of the type shown and claimed in pending U.S. Patent Application Ser. No. 621,255.

The plurality of vertically-arranged studs that define the frame of the wall unit 10 run from and are secured to a U-shaped cap 34 and U-shaped track 36 at their upper and lower ends, respectively. Drywall panels 38, 40 and 42 enclose the metallic frame and provide facings for the wall unit.

Prior to constructing an office from partitions of the type shown in FIG. 1, markings, including the lines 44 and 46 are made on the floor 47 of the "shell" structure. Such markings are very carefully drawn and located from the detailed floor plan to be implemented. An essential to proper construction of the partition arrangement and realization of the customer's desired office plan is the careful and exacting adherence of the placement of the sections of the partitions to the customer's architectural plans. The actual implementation of the plan, of course, relies upon a combination of the skill of the installer and the difficulty of the task presented to him. An essential feature and advantage of the present invention, to be shown and discussed below, is the manner in which installation of a wall unit is enhanced and the resulting product rendered reliably exacting and to the customer's specifications by means of incorporation of wall studs in accordance with the invention. Further, by simplifying the ease of installation with which the workman may exactly adhere to the floor markings, such as the markings 44 and 46 that are conventionally provided for locating the wall brackets 30, 30', 32 and 32' and their supports, the use of the studs can dramatically lower installation costs and minimize costs incurred through revision of unsatisfactory work. Less skilled labor is required to install a partition arrangement including wall units that are framed with wall studs in accordance with the invention. Alternatively, skilled labor can install such partitions with greatly increased speed.

FIG. 2 presents an exploded perspective view of the cooperative arrangement of a wall standard, bracket support and stud in accordance with the invention. As mentioned, supra, the bracket support 28 is as shown in Applicants' invention entitled "Integral Bracket Support". Briefly, that bracket support arrangement is adapted to hold an elongated wall standard 50 upright whereby it may receive, within an interior slot 52, a mating, inwardly protruding tongue portion of a wall bracket (not shown).

Edge notches are provided in the sides of the wall standard 50 that act as regions for accepting inwardly-projecting keys (not shown) which interlock the vertical position of the wall standard within a roll formed elongated housing which defines the bracket support 28. The support 28, formed of a single roll formed piece of sheet metal or sheet steel, includes a lateral channel 48 for accepting the wall standard 50, an interiorly projecting portion 56 for accommodating the interior tongue that interlocks with the slotted wall standard 50, an outwardly projecting passageway 58 formed between the outwardly projecting roll formed blade members 60 and 62 and the aforementioned mounting flanges 24 and 26. A lengthwise covering 64 of elastomeric material may be employed for aesthetic purposes. While the invention is illustrated with reference to this particular bracket support, it is nonetheless compatible with other particular structures of like nature and not limited either in utility or otherwise thereto.

The wall stud 12 of the invention is preferably formed of two identical cold rolled portions arranged back-to-back as in a mirror image. The separate roll formed portions are "stitched" together along the length of the double strength common web 14 by means of interlocking tongue and slot arrangements shown more clearly in FIG. 4.

FIG. 3 is a horizontal section of the wall unit 10 taken at line 3—3 of FIG. 1 that, in conjunction with the perspective view of FIG. 2, gives a ready understanding and illustration of the stud 12 and its function with regard to the remainder of the partition structures. Viewing corresponding portions of these two figures, it can be seen that each of the two mirror image paired portions that comprise the stud 12 includes a series of roll formed bends that project outwardly from the common double strength web 14 to form, when assembled (i.e. stitched together) a structure that includes an easily accessible surface cavity for simplified mounting of the bracket support 28. Further, the stud, an economically manufactured roll formed structure, as a consequence of the numerous folds, possesses significant rigidity and stiffness regardless of the presence or absence of a bracket support 28 and therefore is a meritorious structural element standing alone.

Viewing the sectional geometry of the stud 12, angle bends 66, 66' adjacent the web 14 join inwardly projecting segments 68 and 68' respectively to form a rear channel for accepting the interiorly projecting portion 56 of the bracket support 28.

Outwardly directed shoulders are formed adjacent the rear channel by the orthogonally-folded inner flanges 72, 72' and interior edges 74 nd 74' respectively. The outwardly projecting shoulders define an open surface channel therebetween. The surface channel is adapted to accommodate the lateral channel 48 of the bracket support 28. As opposed to prior art means for retaining a shelf bracket supporting apparatus, the open surface channel of the stud 12 demands neither the awkward and tricky sliding of the wall standard 50 into place within a substantially fully enclosed channel nor the aligning of a bulky unit including both wall standard and stud. Further, the surface channel is easily plumbed to assure correct placement throughout its elongated length. The use of a 25 double portion stud is, of course, superior in terms of ease of installation to that of independent, paired studs that require much attention to the tasks of alignment and maintenance of proper separation distance throughout their lengths for both accuracy of construction and proper appearance.

At the opposite end of the common web 14, there exists a corresponding construction for receiving a bracket support. Unlike that described supra, the surface and rear channels defined, in part, by the opposed inwardly projecting segments 96 and 98 and the orthogonally-folded inner flanges 100 and 102, do not house a bracket support. This permits one to observe that the stud portions have been rolled so that the angles created between the adjacent inwardly-projecting segments and orthogonally-folded inner flanges are slightly less than ninety (90°) degrees. Thus, absent a bracket support, the rear channel presents a somewhat narrowing, pincer-like appearance between the inwardly-projecting segments 96 and 98. This feature of the geometry of the stud further simplifies the wall unit assembly process. The pincer action is sufficient to hold the bracket support, thereby freeing both of the installer's hands for the other required construction tasks, such as drilling screw holes, checking alignment and the like. Further, Applicants have found that the bracket support unit can be adequately secured to the stud for construction purposes by a combination of the above-described pincer action and the taping together of the outer flanges of the stud and the mounting flanges of the bracket support by means of suitable industrial adhesive tape.

Outer flanges 20 and 22 are roll formed adjacent and orthogonal to the interior edges 74 and 74' respectively. As mentioned supra, the outer flanges of the stud match and provide elongated surfaces for engaging the mounting flanges 24 and 26 of the bracket support 28. Interiorly folded outer edges 78 and 78' add further stability and stiffness to the roll formed stud.

The means for attaching the stud 12 to the bracket support 28 and to the drywall panels of the wall unit 10 may be seen in FIG. 3. As is shown, self tapping sheet metal screws, such as the screw 92 secure the matching flanges of the stud 12 and the bracket support 28 throughout their common lengths. Wall screws, such as the screw 94 fix wallboard, stud 12 and bracket support 28 in a three ply sandwich arrangement. Thus, the vertical relationship of the bracket support 28 and wall standard 50 to the stud is additionally secured by the means for attaching the drywall panels 38 and 40. The particular arrangement of means for mounting these elements relative to each other provides substantially greater assurance that the wall standard 50 will maintain its preferred position while bearing the weight and moments transferred to it by the cantilevered shelf and associated loading than is the case in the instance of various prior art arrangements which rely, for example, upon combinations of clips and spot welds.

While spot welds may be seen to be employed liberally in the prior art, their use has been avoided in recognition of the metallurgical degradation and consequent structural weakening that may result from that process. As mentioned above, the two portions of the stud are stitched together as a part of the roll forming process wherein a roll punch, for example, may be utilized.

FIG. 4 is an enlarged sectional view taken at line 4—4 of FIG. 2 which illustrates in detail the structure of the roll formed stitches that secure the common, double strength web 14 of the stud. The separate sheet metal portions forming the stud are indicated at 84 and 86. As is seen in FIG. 2, each stitch represents a tongue-and-slot arrangement. Referring particularly to FIG. 4 it can be seen that these stitch arrangements are provided by first punching through the two portions 84 and 86 of the web 14 (from left to right in the instance shown in FIG. 4) then rolling down the threads from the punching process into a common tongue 88. A common slot 90 remains in the wake of the restructuring of the double strength web 14.

The two portions 84 and 86 forming the double strength web 14 are securely stitched together. As is seen, at the point of attachment or stitch there exists a four-ply structure that is tightly rolled down. This secure arrangement is accomplished without the application of the severe heat gradients that characterize welding and may cause significant metallurgical degradation of the structure.

Thus it is seen that there has been provided by the invention an improved wall stud for use in the framing of conventionally utilized wall units. The stud is both economical to manufacture as a consequence of its simplified structure that is easily amenable to economical roll formation processing without sacrifice of strength or stiffness and economical in terms of installation. By providing an easily accessible surface channel and double stud structure, the stud and bracket support are easily and quickly positioned and fixed in accordance with the architects plans.

While the present invention has been illustrated and discussed with regard to its presently preferred embodiment, its scope is in no wise limited thereto. Rather, it is limited only insofar as defined in the following set of claims and equivalents thereof.

What is claimed is:

1. A roll formed stud for use in framing a wall unit comprising, in combination:

a. a pair of unitary stud portions, each of said portions being a mirror image of the other and arranged back-to-back to form a common web;

b. each of said portions including at least one inner flange and orthogonal interior edge defining a shoulder for forming a surface channel, at least one angularly folded section adjacent said common web, an inwardly projecting folded section adjacent said angularly folded section and said inner flange for forming a rear channel; and c. an acute angle is defined by the junction of said inner flange and said inwardly projecting folded section whereby a pincer is formed for retaining a bracket support.

2. A stud as defined in claim 1 wherein said common web includes at least one stitch member for securing said stud portions.

3. A stud as defined in claim 2 wherein each of said stud portions includes at least one laterally directed folded section adjacent said interior edge for providing a mounting flange.

4. A stud as defined in claim 3 wherein each of said stud portions further comprises an interiorly folded reinforcing edge adjacent said laterally directed folded section.

5. A wall unit construction member comprising, in combination:

a. means for retaining a bracket support;

b. means adapted to receive said last-named means, said means including an open surface channel for accepting said means for retaining a wall standard, said means comprising a pair of unitary stud portions, arranged back-to-back to form a common web, each of said portions including at least one inner flange and orthogonal interior edge defining a shoulder for forming a surface channel, at least one angularly folded section adjacent said common web, an inwardly projecting folded section adjacent said angularly folded section and said inner flange for forming a rear channel; and c. an acute angle is defined by the junction of said inner flange and said inwardly projecting folded section whereby a pincer is formed for retaining a bracket support.

* * * * *